United States Patent [19]

Chotia, deceased et al.

[11] 4,375,138

[45] Mar. 1, 1983

[54] FREE FLIGHT MANEUVERING TOY AIRPLANE

[76] Inventors: John F. Chotia, deceased, late of Ogden, Utah; by Susan M. Boman, personal representative, 588 East on 3450 North, Ogden, Utah 84404

[21] Appl. No.: 277,144

[22] Filed: Jun. 25, 1981

[51] Int. Cl.[3] ..... A63H 27/00

[52] U.S. Cl. ..... 46/79

[58] Field of Search ..... 46/79, 80, 81, 76 R, 46/76 A, 78, 77, 74 R; 273/428

[56] References Cited

U.S. PATENT DOCUMENTS

| | | | |
|---|---|---|---|
| 2,157,448 | 5/1939 | Back | 46/76 R |
| 2,588,941 | 3/1952 | Stark | 46/81 |
| 3,293,793 | 12/1966 | Thomas, Jr. | 46/81 |
| 3,733,737 | 5/1973 | Goodman | 46/79 |
| 4,195,439 | 4/1980 | Kramer | 46/79 |

*Primary Examiner*—Mickey Yu

*Attorney, Agent, or Firm*—A. Ray Osburn

[57] ABSTRACT

A toy airplane adapted to be hand launched into free flight using an elastic band, the airplane being adapted to automatically perform a looping maneuver distantly from the launch point. A forward rigid wing section is provided, being integral with a rearward downwardly flexible wing section having an elevator section upturned along its trailing edge. The plane is adapted to initially dive shallowly after launch, and to thereafter turn upwardly into a complete looping maneuver, to glide thereafter in a nose-up attitude to a tail-down skidding landing. The remoteness of the maneuver from the operator is an important safety feature of the invention.

8 Claims, 5 Drawing Figures

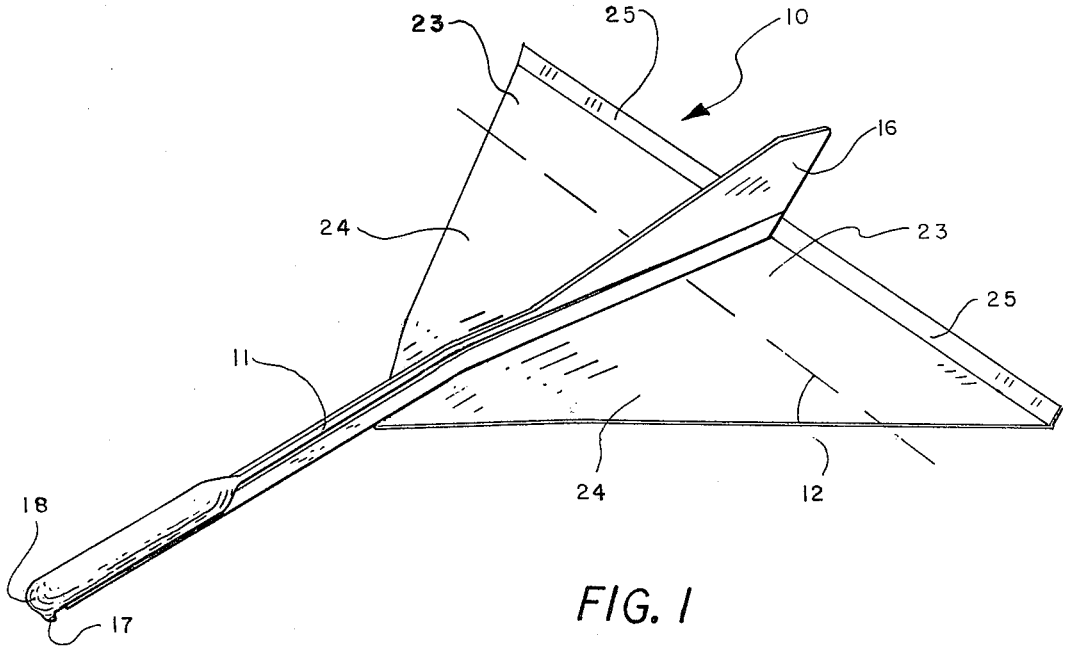
FIG. 1
FIG. 2
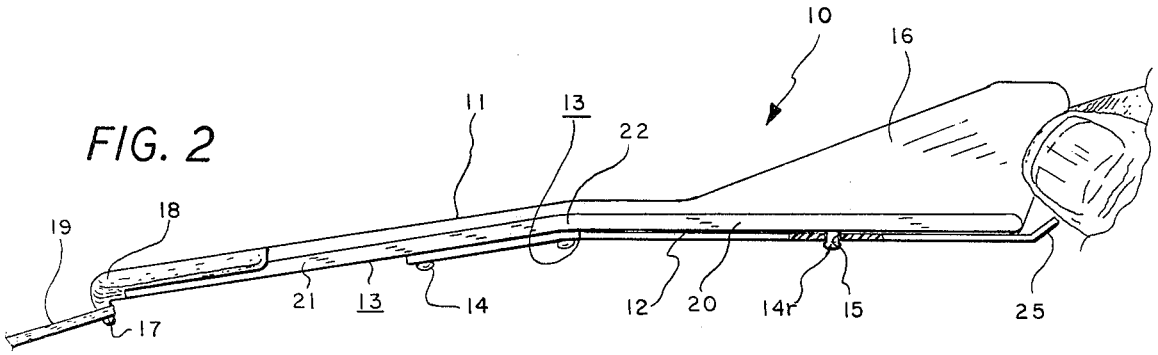
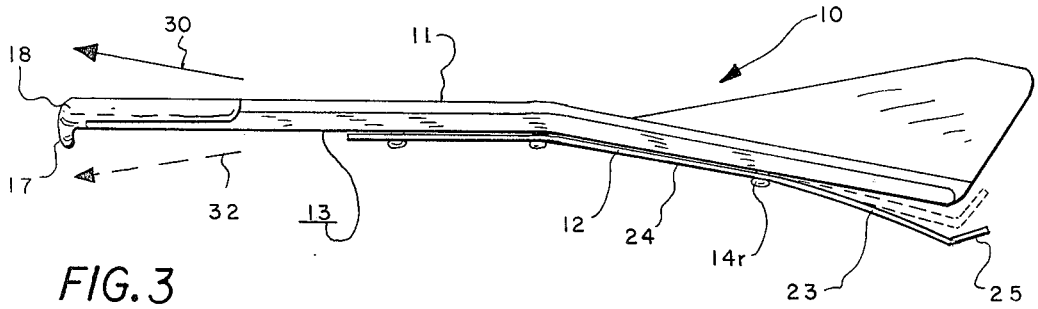
FIG. 3

FREE FLIGHT MANEUVERING TOY AIRPLANE

BACKGROUND OF THE INVENTION

1. Field

The field of the invention is toy airplanes and more particularly such airplanes which are adapted to automatically execute maneuvers after launch into free flight.

2. State of the Art

Among free flight, unpowered airplanes, those hand launched probably pre-date all other types, toy or otherwise, and range from simple folded paper gliders to those capable of more complex maneuvers. Most have employed fixed airfoil geometry, selected to cause the plane to execute somewhat predictable maneuvers such as climbs, banking turns, and even loops. Some have been launched into free flight by impetus directly from the user's hand, while others have utilized catapulting devices, such as tensioned elastic bands. Maneuvers typically begin in the immediate vicinity of the operator, and often return the plane to his vicinity. Some planes are launched at high velocity, and are heavy enough to injure the operator. Some prior art planes provide for airfoil geometry change during flight, induced by air resistance. Hinged tail plane elevators have been utilized, urged toward raised positions by tension springs. At launch, the elevators are quickly snapped into lowered position by high drag. Thereafter, elevator drag decreases with decreasing airplane velocity, the elevators rising to impart upward pitching forces resulting in looping maneuvers. Spring tension is maximum while projected drag area is minimum, so that the geometry of the system is necessarily unstable. The elevators tend to snap unpredictably back into raised position. To assure that the loop occurs remote from the operator, quite high launch velocity is necessary. For a toy, the necessary precision of construction, the required strength and weight, and the demanding carefulness in use are excessive. Cost is unnecessarily high, and performance remains unpredictable.

BRIEF SUMMARY OF THE INVENTION

With the foregoing in mind, the present invention eliminates or substantially alleviates the disadvantages in the prior art by providing an airplane with a rigid forward wing downwardly and forwardly cambered to provide a downward force and a downward pitch moment on the airplane when in flight at substantially zero angle of attack. A rearward wing, elastically flexible laterally to the plane is provided comprising a trailing edge elevator portion angled upwardly and rearwardly into the air stream. The forward and rearward wings may be integral or separate. The rear wing, because of the elevator, provides downward force and an upward pitch moment to the airplane throughout the flight. However, because of the flexibility of the wing, the amount of the downward force and upward pitch moments increase only to a constant value with increasing forward velocity. The forward and rearward wings are configured and positioned so that the net force and pitching moment during the initial period following launch cause the plane to nose downwardly. As the plane slows during free flight, the flexible section provides increasing upward moment relative to the downward moment of the forward section, so that the plane eventually begins to turn upwardly, the forces on the forward section transitioning through zero to net upward force and net upward pitch moment. The resultant upward force and upward pitch moment combine with the inertia of the plane to cause the plane to execute an upwardly turning loop. Preferably, the forward and rear sections are so configured that the plane executes a backward loop of about 270°, the plane then passing through its previous flight path. It is also preferable that the net forces and pitching moment in the nose up direction be positive at the terminal falling velocity of the airplane, so that it automatically when falling, noses up at the terminal velocity into a gliding nose up attitude for a soft tail-down landing without damage to the airplane.

BRIEF DESCRIPTION OF THE DRAWINGS

In the drawings, which represent the best mode presently contemplated for carrying out the invention, FIG. 1 is a perspective representation of an airplane in accordance with the invention, drawn to substantially full scale, FIG. 2 a side elevation view of the airplane of FIG. 1 being represented in the launching process, drawn to the same scale, FIG. 3 a side elevation view of the airplane of FIG. 1 represented as being in flight, drawn to the same scale, FIG. 4 a pictorial representation of typical flight paths of the airplane of FIG. 1, and FIG. 5 a graphical representation of the lift forces upon the airplane of FIG. 1 in respect to the forward velocity of flight.

DETAILED DESCRIPTION OF ILLUSTRATED EMBODIMENTS

Figure 5:
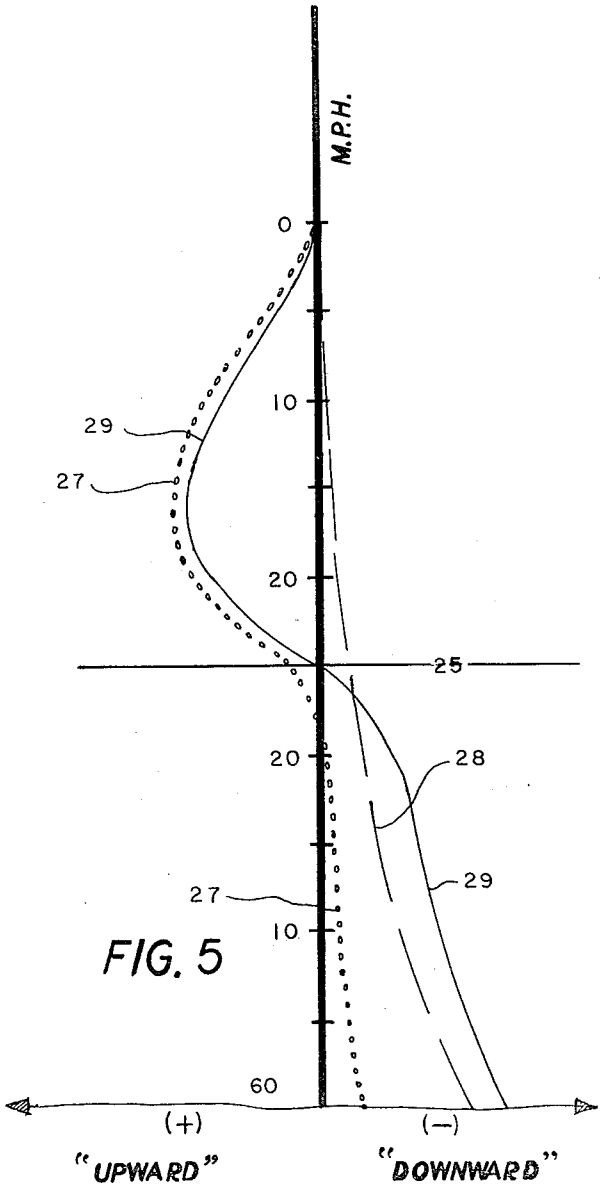

A free flight maneuvering toy airplane 10 in accordance with the invention is illustrated in FIGS. 1–3. A central elongate "backbone" member 11 carries a wing member 12 affixed to its bottom surface 13 by knobs 14 engaging matching snap-on holes 15 in the wing member. Fin 16 extends vertically from backbone 11, and a launch hook 17 is provided on nose 18, illustrated in FIG. 2 engaged by an elastic launching band 19. Band 19 is held by a launching stick or fork, not shown, held as by the user's left hand, his right hand engaging the tail fin 16 to stretch band 19.

Backbone 11 has a rearward generally straight portion 20 and a forward generally straight portion 21 joined by a short curving portion 22. Wing 12 is of thin flexible elastic material, such as calendered vinyl of about 0.010 thickness, and generally conforms to curved under surface 13 of backbone 11. Rearwardly of the rearmost knob **14*r*, rear section 23 of wing 12 is free to flex downwardly from surface 13 in response to aerodynamic forces during flight. Forwardly of knob 14*r*, forward section 24 of wing 12 is substantially rigid both longitudinally and laterally to backbone 11. Rear wing section 23 has an upturned elevator portion 25 continuous across the trailing edge of wing 12. Elevator 25 renders rear section 23 substantially rigid laterally to backbone 11, while it is substantially flexible longitudinally to backbone 11. (FIG. 3**)

Figure 4:
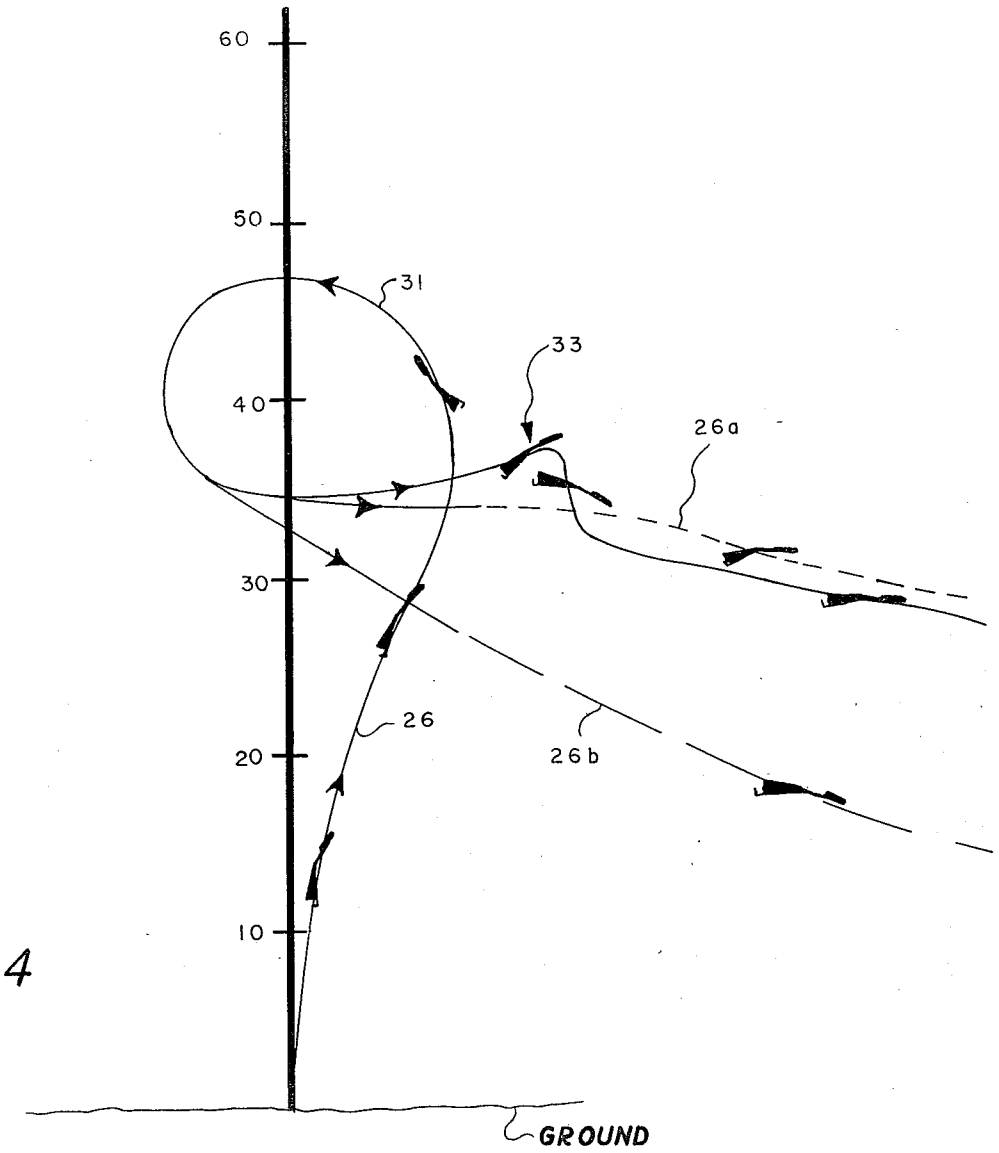

Typical free flight paths 26,**26*a* and 26*b* are illustrated in FIG. 4, plane 10 being shown in out-of-scale silhouette at various points. In this illustration, plane 10 is launched in preferred straight up direction, although it may be launched angled substantially away from vertical. (e.g. 45°) In FIG. 5, the aerodynamic forces upon plane 10 are illustrated qualitatively in reference to the forward velocity of plane 10 during a flight such as those illustrated in FIG. 4. Dotted curve 27 represents lift forces upon rigid forward wing section 24, dashed curve 28 those upon the flexible rearward wing section 23, and solid curve 29 the resultant lift force upon airplane 10. Drag and gravity forces are not indicated. The "+" or "upward" forces act upon wing 12 toward backbone 11**, while the "−" or "downward" forces are directed oppositely.

Plane 10 "dives" horizontally from the vertical during the initial phase of flight following launch, until the forward (vertical) velocity has decreased from 60 to 25 mph., for example, from drag and gravity forces. The forces on both rigid and flexible sections 23 and 24 during this phase of flight are "downward." Section 23 flexes well downward because of high air resistance on elevator 25, decreasing its upward pitching moment, and plane 10 flys in a nose "down" attitude, as along flight path vector indicated by arrow 30, (FIG. 3), under the influence of the nose down moment provided by rigid forward section 24.

At about 25 mph., decreasing drag forces on elevator 25 allows section 23 to flex upwardly, increasing its upward pitching moment, causing plane 10 to nose upwardly into the looping maneuver 31 shown in FIG. 4. The forces 27 on the rigid section 24 have at 25 mph., become "upward" and equal in magnitude to the "downward" force 28 upon flexible section 23. Thereafter, the net resultant force 29 upon plane 10 is upwardly directed, causing plane 10 to execute the spiraling loop 31. The flight path vector is now as arrow 32. (FIG. 3) As plane 10 completes about 270° of the loop, it has slowed sufficiently so that the upward forces become equal to the gravity forces, producing a stall as at 33. (FIG. 4) Plane 10 then dives, but levels into a gently gliding path, dominated at the low velocity by the upward pitch from drag upon elevator 25, now sharply upstanding. However, stalling may under some conditions not occur as indicated by flight path 26*a* and 26*b*, plane 10 then gliding more smoothly from the loop 31 to the nose up, skidding landing. Note that the "upward" forces 29 on plane 10 tend to become maximum at its terminal falling velocity, (17 mph.) so that, the pitch moment being nose up, plane 10 automatically assumes the gliding attitude from free fall. This is an important safety consideration in the design of plane 10.

The flight paths and the force vectors of FIGS. 4 & 5 are illustrative only. Both the patterns of the force variations, and the height of the flight may vary with flight conditions, as well as with detailed design of airplane 10. For example, when the ambient temperature is in the neighborhood of 100° F., the loop tends to occur at much higher elevations of 60–70 feet. The vinyl wing 10 is much more flexible at such elevated temperatures, decreasing drag on plane 10 and reducing the forward velocity at which elevator 25 comes into play, both pushing the loop 31 to higher altitudes. Conversely at temperatures of about 30° F., section 23 is much stiffer so that more drag resistance is created by elevator 25, the plane slowing more rapidly to the looping point, roughly 30 feet upwardly from the launch point.

The dimensions and configurations of the wing and backbone can be varied considerably without destroying basic looping maneuver 31. The forward rigid section 24 and the aft flexible section 23 could be provided through separate wind surfaces, rather than the illustrated integral construction. The illustrated design of airplane 10 is experimentally confirmed. Backbone 11 is approximately 6¼" long, section 21 being 3¼" and section 20 being 3". Wing member 12 has a longitudinal length along backbone 11 of about 4¼", and a trailing width of 4½". Elevator 25 angles upwardly about 45° and is about ½" in width. The wing 12 is of calendered vinyl about 0.010" thick. The flexible section 23 is about 1¼" wide. Portions 20 and 21 of backbone 11 are angled about 10° from each other. The total weight is approximately 1½ ounces.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. A toy airplane adapted to be launched into unpowered free flight, comprising:

a rearward wing of elastic material adapted for flexure transversely to the direction of flight in response to aerodynamic forces thereon, and having a trailing edge and a leading edge both transverse to the direction of flight, and a trailing elevator portion continuous the full width of the trailing edge, being angled rearwardly upwardly therefrom, so that the resultant aerodynamic force on said wing is downwardly directed at all flight velocities;

a forward wing extending downwardly and forwardly from the leading edge of the rearward wing and adapted to be substantially rigid during flight;

stabilizer fin means; and a rigid elongate central backbone member; and wherein the forward rigid and the rearward flexible wing are integral, being of a single sheet of elastic material, the rigid wing comprising a forward portion of the sheet secured fixedly to the backbone, and the flexible wing comprising a rearward portion of the sheet being free to bend downwardly from the backbone.

2. The airplane of claim 1, wherein:

the rigid forward and the flexible rearward wing are configured, sized and positioned upon the airplane so that;

the resultant force on the forward wing is downwardly directed and imparts a downward pitching moment to the airplane at the velocities during the initial period of free flight following launch, and the resultant force on the flexible wing is downwardly directed and imparts an upward pitching moment at all velocities throughout the flight, said moment being smaller than said downward pitching moment during the velocities of said initial period of flight, the airplane executing a shallow dive during said initial period, the upward pitching moment from the rearward wing becoming greater than the downward pitching moment of the forward wing at the velocity at the end of the initial period, the plane then pitching upward until the resultant force on the forward wing is upwardly directed and imparts an upward pitching moment to the airplane following said initial period, the plane then executing an upward and backward rolling maneuver.

3. The airplane of claim 2, wherein:

the direction of flight of the airplane changes at least approximately 270° during the rolling maneuver.

4. The airplane of claim 3, wherein:

the airplane is adapted for nose up gliding flight to ground following said maneuver, when it is launched substantially upwardly from horizontal.

5. The airplane of claim 3, being adapted for a launch velocity of 50 to 60 miles per hour.

6. The airplane of claim 5, being adapted to execute the rolling maneuver approximately 40 to 50 feet from the point of launch.

7. The airplane of claim 1, wherein:

the single sheet of elastic material is of calendered vinyl of 0.010" thickness, in the shape of a triangle having a height in the direction of the backbone of 6¼" and an elevator width of ½";

the back bone member comprises a rearmost portion 3" long and a foremost portion 3¼" long joined by a central curved portion so that the foremost portion is angled with respect to the rearmost portion approximately 10°; and the width of the flexible wing is 1¼" in width measured parallel to the backbone, and the elevator portion is angled upwardly 45° and is ½" in width.

8. The airplane of claim 1, wherein:

the rigid forward and the flexible rearward wing are configured, sized and positioned upon the airplane so that the airplane, when released to fall nose down under the influence of gravity pitches into gliding flight before reaching its terminal falling velocity.

* * * * *